US005906303A

United States Patent [19]

Carone et al.

[11] Patent Number: 5,906,303

[45] Date of Patent: May 25, 1999

[54] BATON HOLDER

[76] Inventors: Nicholas J. Carone, 4205 San Fernando Rd., Glendale, Calif. 91204; Loren Evan Farell, 19711 Tuba St., Chatsworth, Calif. 91311

[21] Appl. No.: 08/832,237

[22] Filed: Apr. 3, 1997

[51] Int. Cl.[6] ..... A45F 5/00

[52] U.S. Cl. ..... 224/251; 224/914

[58] Field of Search ..... 224/251, 914, 224/915, 671, 674, 675; 463/47.6

[56] References Cited

U.S. PATENT DOCUMENTS

| | | | |
|---|---|---|---|
| 372,000 | 10/1887 | Wintz . | |
| 710,236 | 9/1902 | Audley | 224/251 |
| 3,307,754 | 3/1967 | Anketell . | |
| 4,006,851 | 2/1977 | Kippen . | |
| 4,424,923 | 1/1984 | Bingham . | |
| 4,644,610 | 2/1987 | Fish . | |
| 4,662,552 | 5/1987 | Uhehara | 224/251 |
| 4,694,981 | 9/1987 | Miller, Jr. | 224/251 |
| 4,730,728 | 3/1988 | Larkin | 224/675 X |
| 4,856,688 | 8/1989 | Ackmann | 224/251 X |
| 4,884,730 | 12/1989 | Carpenter . | |
| 4,936,499 | 6/1990 | Gulley . | |
| 5,386,932 | 2/1995 | Gross . | |

*Primary Examiner*—Renee S. Luebke
*Attorney, Agent, or Firm*—Loeb & Loeb LLP

[57] ABSTRACT

A baton holder formed of a coated solid unitary frame having an open inner diameter for receiving the baton includes a resilient lip, formed integrally with the coating, to grip the baton when inserted in the baton holder and a cradle that extends upwardly having a concave surface facing the inserted baton to cradle the baton and thereby stabilize it in the baton holder. An attachment portion facilitates attaching the baton holder to the belt of a user by means of an attachment loop. The resilient lip may be formed in a snap-on insert, removably mounted on the frame, that includes at least one resilient leaflet. The insert obviates the need for the coating and facilitates removal and replacement of the insert when required.

6 Claims, 2 Drawing Sheets

FIG. 5
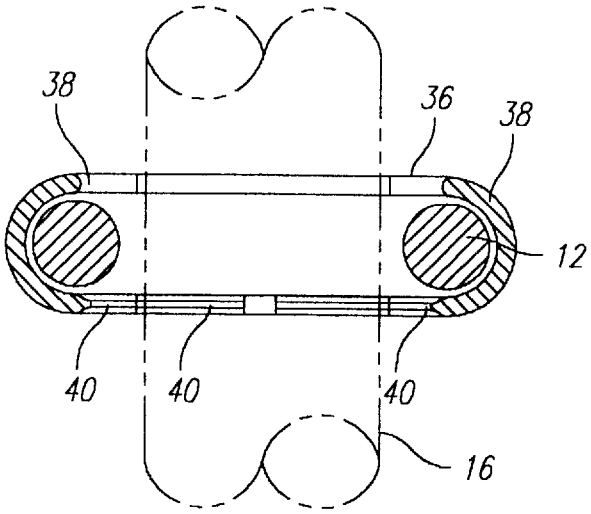
FIG. 4
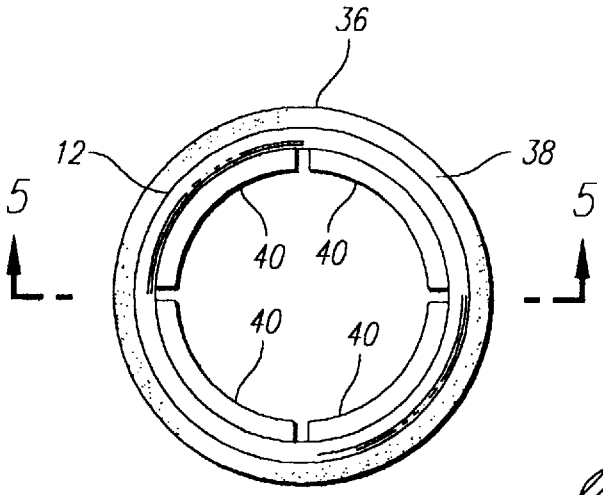
FIG. 7
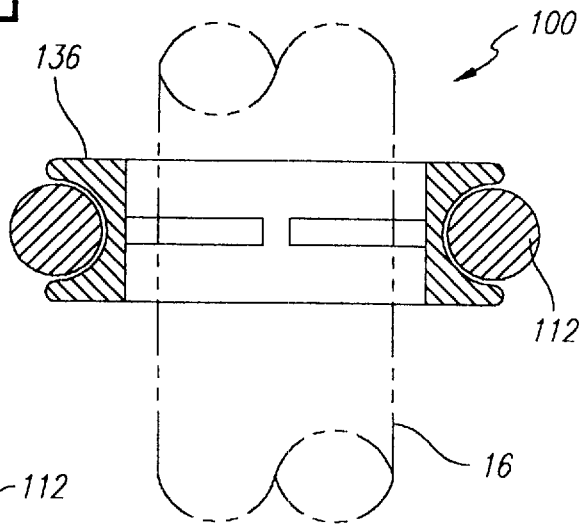
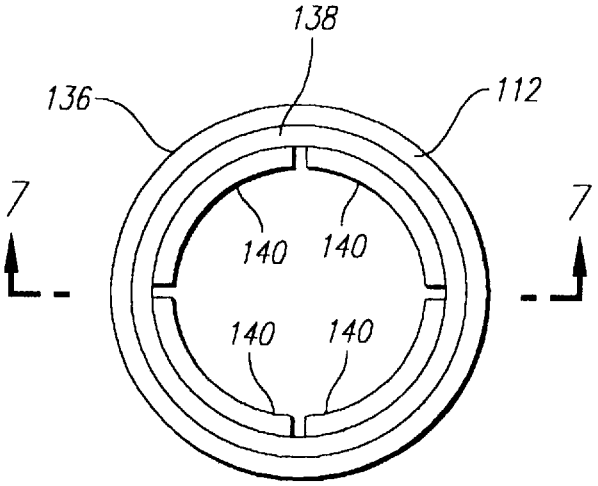
FIG. 6

BATON HOLDER

BACKGROUND OF THE INVENTION

1. Field of the Invention

The present invention relates to a device for holding a baton or night-stick of the type normally carried by police, security officers, military personnel and the like, and in particular to a baton holder that provides for rapid insertion and withdrawal of the baton from the baton holder, yet maintaining the baton in a secure and stable condition when positioned in the baton holder.

2. Description of the Related Art

Batons have been widely used by law enforcement personnel for quite some time as, for example, in law enforcement, self defense and crowd control. Baton holders are known in the art and examples of such are shown in U.S. Pat. Nos. 710,236, 372,000, 3,307,754, 4,006,851 and 4,424,923 to identify a few. Typically, a baton holder, which is attached to a user's belt, includes a metal ring through which the baton is inserted. Normally, the baton has an elongated cylindrical shaft of a diameter smaller than that of the ring and a shoulder or handle having a diameter larger than the ring so that the baton is insertable into the ring only up to the handle. In such case, the baton rests in the ring in a loosely confined manner which creates potential inconveniences and more importantly hazards to the officer carrying the baton. For example, the baton may readily pop out of the ring when the officer is running, bending over or jumping, while in pursuit. The officer may be preoccupied with stabilizing the baton in the baton holder during his movements, thus interrupting his concentration, thereby distracting him from his pursuit strategy. The freedom of movement of the baton in the baton holder may also result in injury to the officer during rapid movement.

Furthermore, the ease of removal of the baton from the ring compromises the officer's safety since an adversary or assailant may readily remove the baton from the baton holder while the officer is involved in policing activities and not focused on maintaining the baton in the ring.

Accordingly, what is needed is a baton holder that provides for easy insertion and withdrawal of a baton while maintaining the baton in a secure and stable condition during use.

SUMMARY OF THE INVENTION

In accordance with the present invention, a baton holder is provided that is formed of a unitary rigid frame which includes an open annular ring sized to receive a baton. The annular ring has an inner surface defined by an inner diameter that includes a resilient lip projecting therefrom that secures the baton in place when the baton is inserted in the baton holder. A cradle that has a concave surface for cradling the baton, extends upwardly from the ring. Thus, when inserted in the baton holder, the baton extends adjacent the cradle and the cradle stabilizes the baton's movement relative to the baton holder. A u-shaped belt attachment extension that projects from the ring enables the baton holder to be attached to the belt of a user by means of an attachment loop which may be looped around a belt and the baton holder.

The baton holder is covered by a resilient coating such as one of any number of rubbers, polyurethanes, silicones and the like. A resilient lip, formed as an integral part of the coating, extends from the coating in the region of ring's inner surface. The resilient lip is positioned such that upon insertion of the baton in the baton holder the lip compresses against the baton to provide a friction fit therebetween to secure the baton in the baton holder.

The resilient lip may also be formed as a plurality of resilient leaflets formed as an integral part of an insert that is fitted for retention on the ring. The insert includes a grip or locking edge that fits snugly on the ring to hold the insert on the ring despite repeated insertion and withdrawal of the baton from the baton holder, while allowing removal of the insert from the ring for purposes of replacement. Additionally, since there are tens of thousands of baton holders in use today, it would be desirable to have a means of converting the existing baton holders, easily and inexpensively. Accordingly, according to the present invention, separate insert made of a deformable rubber can be inserted into the opening of an existing baton holder. The insert is deformable so as to be able to be inserted and removed. This permits the sale of the deformable insert separate from the existing baton holder itself.

Accordingly, there is provided a baton holder that accommodates rapid insertion and withdrawal of the baton from the baton holder while maintaining the baton in a secured and stable condition when inserted in the baton holder.

BRIEF DESCRIPTION OF THE DRAWINGS

FIG. 4 is a top plan view of the ring portion of the baton holder with an insert.

FIG. 5 is a cross sectional view along line 5—5 of FIG. 4 with a portion of a baton shown in hidden line.

FIG. 6 is a top plan view of a ring portion of an existing baton holder with a separate insert.

FIG. 7 is a cross sectional view along lines 7—7 of FIG. 6 with a portion of a baton shown in hidden line.

DETAILED DESCRIPTION OF THE INVENTION

Figure 1:
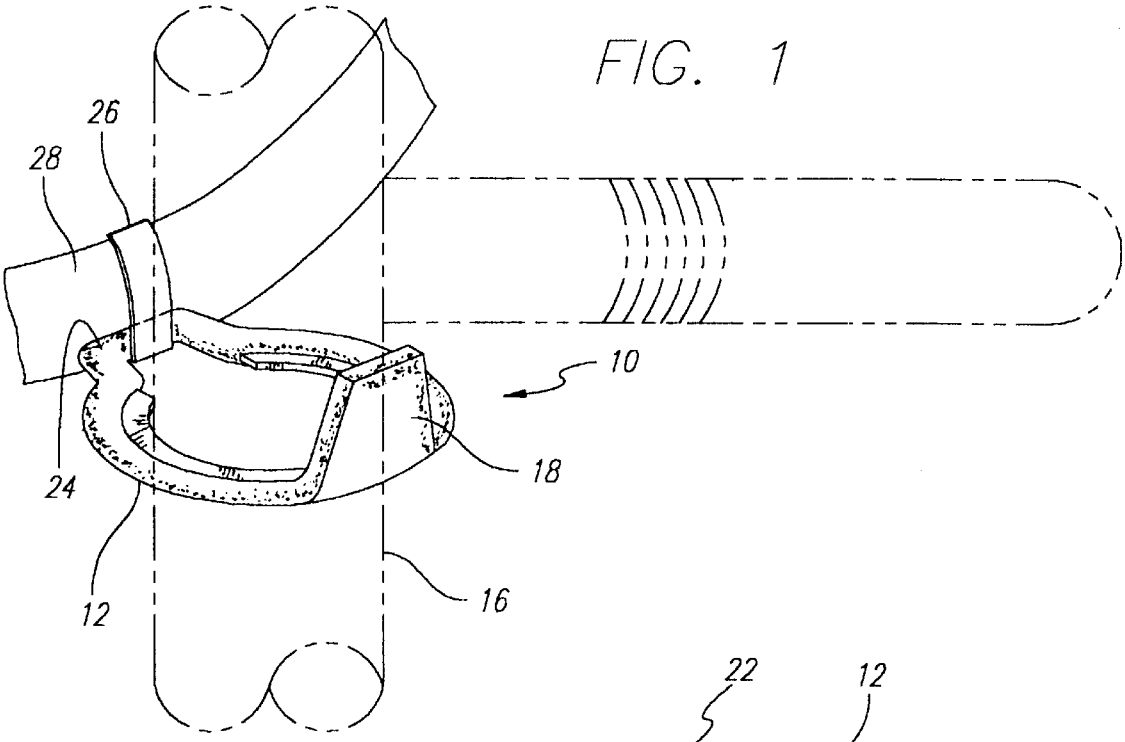
FIG. 1 is a perspective view of the preferred embodiment of the baton holder with the baton, shown in phantom, inserted in the baton holder.
Figure 2:
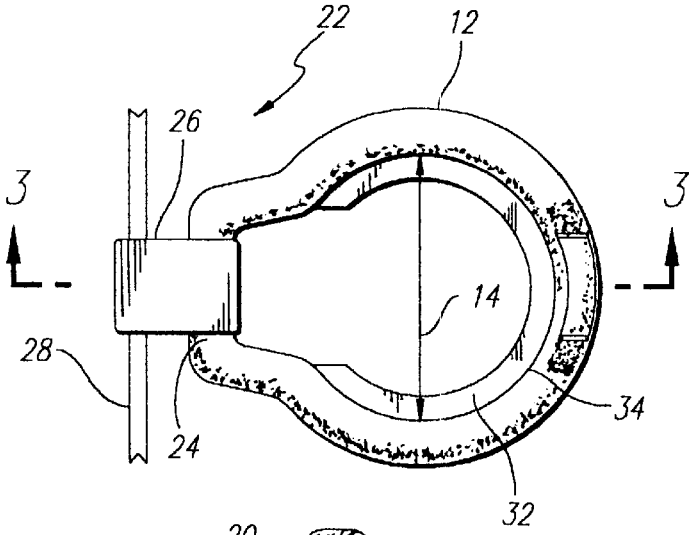
FIG. 2 is a top view of the baton holder secured to a belt with an attachment loop.
Figure 3:
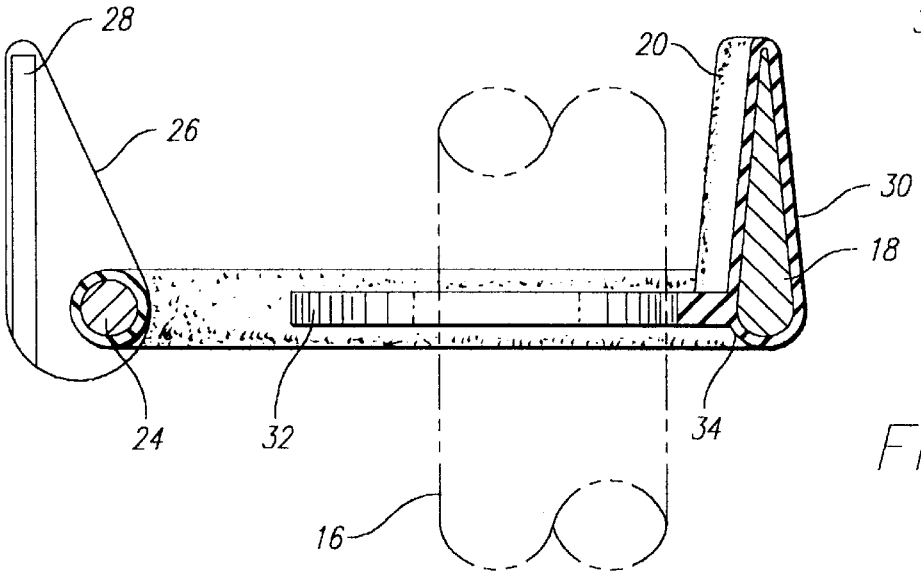
FIG. 3 is a cross-sectional view of the baton holder taken along line 3—3 of FIG. 2.

Referring now to the figures and in particular to FIGS. 1, 2 and 3, the baton holder for a baton according to the present invention is shown and referenced generally by the numeral 10. Baton holder 10, a unitary rigid frame formed of materials such as metal or hard durable plastic known in the art, consists of an annular ring portion 12 having an inner diameter 14 that defines an open region of the baton holder 10 through which baton 16 may be inserted. Cradle 18 which extends upwardly from ring portion 12 has an inwardly facing concave surface 20 having a radius of curvature equal to that defined by inner diameter 14. In common practice, baton 16 is cylindrical having a diameter slightly smaller than inner diameter 14. Accordingly, when the baton 16 is inserted in the baton holder 10, cradle 18 partially surrounds the baton 16 (as shown in FIG. 3), to stabilize or inhibit the motion of baton 16 when inserted in baton holder 10. A belt attachment portion 22 extends from the ring portion 12 and lies in a plane defined by the ring portion 12. Attachment portion 22 includes a straight bar 24 about which may be placed attachment loop 26 that serves to attach baton holder 10 to a user's belt 28. Attachment loop 26 may be formed of a number of materials, known in the art, such as leather, nylon mesh and the like and may be locked in place using conventional arrangements such as a buckle, snap-button or other methods known in the art.

Baton holder 10 includes a coating 30 of elastomer material such as rubber, polyurethane, silicone and the like. A resilient lip 32, formed as an integral part of the coating 30, extends away from ring surface 34 and is positioned on the baton holder 10 so as to provide an interference fit with a baton inserted in baton holder 10. In this manner, lip 32 compresses against baton 16 thereby securing it in baton holder 10. The resiliency of coating 30 and the amount lip 32 extends away from ring surface 34 (defined by inner diameter 14) are selected to provide rapid insertion and withdrawal of baton 16 while maintaining baton 16 secure in baton holder 10 during normal and even rapid and exaggerated movements by the user. Lip 32 may be formed on baton holder 10 during the coating process by forming techniques known in the art.

With reference now to FIGS. 4 and 5, an alternate embodiment of the resilient lip is shown, which includes a unitary insert 36 fitted over ring portion 12 by means of snap-on assembly and held thereon by means of locking edge 38. Although a single or any number of individual spaced apart leaflets may be used to form the resilient lip, the example of FIG. 5 shows four individual leaflets 40 spaced equally apart and capable of compressing against the baton 16 in the manner previously described.

As shown in FIG. 4, insert 36 is sized to fit snugly over ring portion 12 with sufficient retention force that baton 16 may be inserted and withdrawn against the compressive forces exerted by the leaflets 40 and the insert will nevertheless remain in place throughout the use of the baton holder 10. Convenience in assembly of baton holder 10 and replacement of insert 36 is provided by means of the snap-on nature of insert 36.

Referring to FIGS. 6 and 7 an alternative embodiment of the present invention is shown in the form of a separate insert 136 made of a deformable rubber material which can be inserted into the annular ring portion 112 of an existing baton holder 100. The insert 136 is deformable so as to be inserted and removed from the inner ring 112. This permits the sale of the insert 136 separate from the existing baton holder itself.

As shown in FIG. 7, the insert 136 is fitted within ring portion 112 by means of a snap-fit assembly and held thereon by the locking edge 138. The resilient lip of the insert 136 may be unitary as described above for baton holder 10 or may have a number of leaflets 140 capable of compressing against the baton 16 to provide an interference fit with the baton 16.

Obviously, other alternate designs may be provided by one skilled in the art to mimic the function provided by insert 36 without departing from the inventive concepts disclosed herein.

What is claimed is:

1. A baton holder for holding a generally cylindrical baton to a belt of a user, said baton holder comprising a unitary rigid frame having an annular ring portion with an opening having an inner diameter to receive the baton, said annular ring portion having a resilient coating for gripping a baton, a cradle portion extending from the ring portion, the cradle portion having a concave surface adapted to contact a baton inserted in the baton holder to stabilize said baton and a belt attachment portion extending from the ring portion and adapted to receive an attachment loop operative to attach the baton holder to the belt of the user.

2. The baton holder of claim 1, wherein the ring portion defines a plane and wherein the belt attachment portion includes a u-shaped extension adapted to receive an attachment loop, said u-shaped extension extending from the ring portion in said plane.

3. The baton holder of claim 1, wherein the ring portion defines a plane and wherein the cradle portion extends upwardly from the ring portion orthogonally to said plane.

4. The baton holder of claim 1, wherein the concave surface has a radius of curvature equal to the radius of curvature defined by the open inner diameter.

5. The baton holder of claim 1, wherein said resilient coating includes a flexible lip extending from and positioned on the ring portion in a manner, such that upon insertion of a baton into the baton holder, the lip compresses against the baton to provide a friction fit therebetween to secure the baton in the baton holder.

6. The baton holder of claim 1, further including gripping means projecting from the ring portion to the inner diameter of the opening for providing a press fit between a baton and the baton holder when the baton is inserted into the baton holder.

* * * * *